United States Patent [19]

Daniels et al.

[11] 4,320,478

[45] Mar. 16, 1982

[54] DIGITAL WATCH

[75] Inventors: Richard G. Daniels; Richard S. Walton; Roy K. Yamanouchi, all of Tempe, Ariz.

[73] Assignee: Motorola, Inc., Schaumburg, Ill.

[21] Appl. No.: 592,842

[22] Filed: Jul. 2, 1975

[51] Int. Cl.[3] ..... G04C 16/00; G04C 9/00

[52] U.S. Cl. ..... 368/69; 368/187

[58] Field of Search ..... 58/23 R, 50 R, 85.5, 58/4 A; 368/69-70, 82-84, 185-188, 239-242

[56] References Cited

U.S. PATENT DOCUMENTS

| | | | |
|---|---|---|---|
| 3,664,116 | 5/1972 | Emerson et al. | 58/50 R X |
| 3,707,071 | 12/1972 | Walton | 58/50 R |
| 3,754,392 | 8/1973 | Daniels | 58/50 R |
| 3,760,406 | 9/1973 | Walton | 58/50 R X |
| 3,765,163 | 10/1973 | Levine et al. | 58/50 R |
| 3,845,615 | 11/1974 | Cake | 58/50 R |
| 3,943,696 | 3/1976 | Portmann et al. | 58/85.5 X |
| 3,984,973 | 10/1976 | Ho | 58/50 R |
| 3,991,552 | 11/1976 | Ho et al. | 58/4 A |

OTHER PUBLICATIONS

Ainsworth et al., "IBM Technical Disclosure Bulletin", vol. 16, No. 4, Sep. 1973, p. 1296.

*Primary Examiner*—Vit W. Miska

*Attorney, Agent, or Firm*—Michael D. Bingham

[57] ABSTRACT

A digital watch including a clocking signal generator is disclosed wherein a control circuit provides phasing signals for multiplexing data representing seconds, minutes, hours, and data information in successive cycles to a visual display panel. In the normal mode of operation of the watch, minutes and hours are displayed. The watch further includes circuitry for selectively displaying seconds and date information as well as for setting the hours, minutes, and date. The aforementioned functions require the utilization of only three functional switches which may be incorporated into a stem of the watch. By selectively closing and opening one switch, as for example, pushing in and releasing the stem, seconds information is first displayed and then the date information is momentarily displayed for a predetermined interval after which the watch returns to a normal mode of operation of displaying hours and minutes.

21 Claims, 10 Drawing Figures

CLOCKING SIGNAL
18

16
62'
60
186
÷10
188
÷6
190
÷10
192
÷6
194
÷10
196
÷1.2
198
÷10
200
÷3.1
202
204
206
208
210
212
214
216
TO DECODER 20

FROM REGISTER 188

236
238
190
220
222
224
226
R FF
242
R.S. FF
228
230
232
234
244
246
248
250
TO DECODER 20
240
239
TO REGISTER 192

DIGITAL WATCH

BACKGROUND OF THE INVENTION

This invention relates to digital electronic watches and more particularly to liquid crystal display watches for digitally displaying time information.

Liquid crystal display watches available today do not employ multiplexing techniques for displaying time information. Therefore, separate binary decoders are utilized for each of the functions, i.e., hours, minutes and seconds, that are to be displayed. Thus, the complexity of the circuit of the prior art watches are directly related to the number of functions to be displayed as, therefore, is production cost.

Moreover, most of the prior art liquid crystal display watches, in a normal mode of operation, display hours and minutes information. On command by the user, for example, by depressing the stem of the watch, seconds information is displayed until the stem is released, at which time, the hours and minutes information is once again displayed. To set hours to the correct time, for example, the stem is rotated away from its neutral position to a first predetermined position and depressed. To set minutes, the stem is rotated away from its neutral position to a second predetermined position and once again depressed. Thus, to display seconds and to set hours and minutes, three separate switch functions are required by the prior art.

Furthermore, if data information is to be provided, prior art watches require a separate switch function to initiate display thereof. Also, another switch is required for setting the data. Thus, to provide for displaying and/or setting of hours, minutes, date and seconds information, prior art digital electronic wrist watches require five functional switches to be employed. Each additional switch required, increases the complexity of the watch circuit and also production cost. Because the digital watch environment is highly competitive, it is very important to maintain production cost at a minimum.

Thus, a need exists to provide a multiplexing technique for liquid crystal watches to minimize circuitry complexity.

A further need exists to reduce the number of switches required for displaying and setting of time information of liquid crystal display digital watches.

SUMMARY OF THE INVENTION

Accordingly, it is an object of this invention to provide an improved digital watch.

It is another object of this invention to provide an improved digital wristwatch utilizing liquid crystal display elements for displaying time information.

A still another object of this invention is to provide circuitry for time multiplexing of the distinct groups of data corresponding to time information which is to be displayed by the liquid crystal display watch.

A further object is to provide a liquid crystal display digital watch employing multiplexing techniques suitable for displaying hours, minutes, seconds and date information utilizing a minimum number of functional switches.

A still further object is to provide a set and demand circuit for a liquid crystal display digital watch which is suitable for reducing the number of switches required to display and to set hours, minutes, seconds and date information.

The digital watch of the invention, including a visual display panel and a clocking signal generator, comprises: memory registers having a plurality of storage locations and which are coupled to the clocking signal generator for storing distinct groups of data therein; visual display output circuitry having a plurality of display locations and further including a plurality of gating circuits; and a control circuit which is operatively coupled to the clocking signal generator, the memory registers, and the visual display output circuitry for reading and transmitting data from the memory registers to the visual display output circuitry in successive cycles, in a multiplex mode of operation. Each of the distinct groups of data are applied to the visual display output circuitry at different predetermined times during each of the aforementioned cycles. The control circuit selectively enables predetermined gating circuits of the visual display output circuitry at a first predetermined time during each cycle whereby information representative of first selected ones of the distinct groups of data are displayed in a first group of display locations of the digital watch when the watch is in a normal mode of operation.

DETAILED DESCRIPTION OF THE PREFERRED EMBODIMENT

In order to provide a clear explanation, the invention is described hereinafter with reference to a liquid crystal display digital watch. However, the embodiment of the invention could be used, to provide multiplexing control signals to drive display systems other than liquid crystals.

Figure 1:
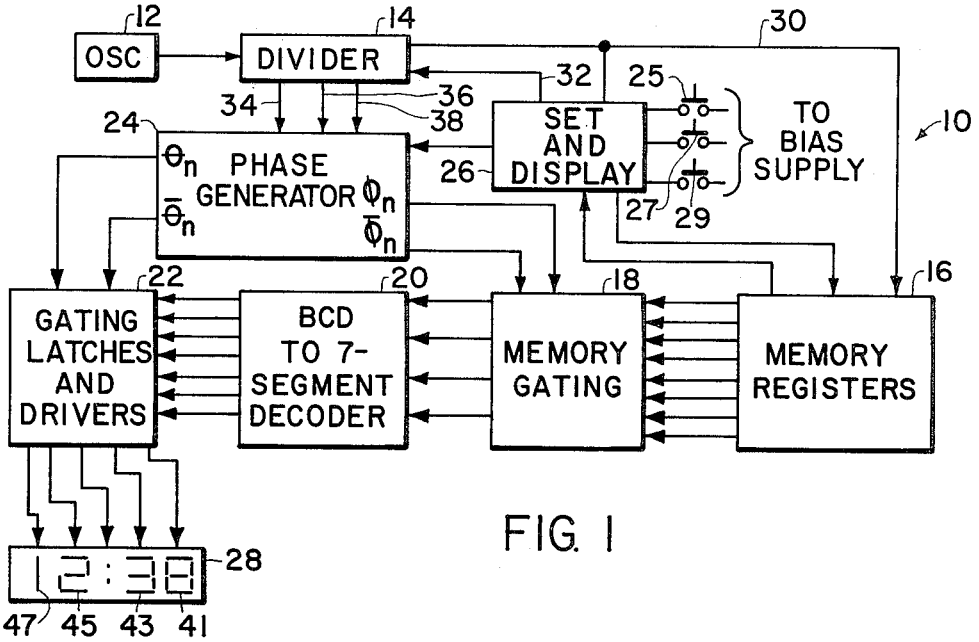
FIG. 1 is a block diagram illustrating the digital watch of the embodiment of the invention.

Referring to FIG. 1, there is illustrated the digital watch of the embodiment of the invention. Digital watch 10 is shown as comprising; crystal control oscillator or clocking signal generator 12, divider circuit 14, memory register circuit 16, memory gating circuit 18, BCD to 7 segment decoder 20, gating latches and driver circuit 22, phase generator 24, set and display circuit 26, and visual display panel 28.

In normal operation, time is continuously being kept with only hours and minutes information being simultaneously displayed on visual display panel 28. The colon indicia, which separates the hours information from the minutes information is on for one second and off for one second as a running indicator for the watch.

On demand, by closing switch 25 for example, seconds information will be displayed. When seconds information is being displayed the hours information is blanked from appearing by the logic circuitry of the watch generating a dummy blanking signal, and the minutes information is disabled by logic circuitry from being displayed, the seconds information being displayed on the two digits formerly used to display the minutes information. The logic circuitry also provides for permanently displaying the colon while seconds are being displayed.

A novel feature of the invention is that data information is displayed upon release of switch 25 for approximately 3 seconds, after which, hours and minutes information is once again continuously displayed. While the date is being displayed in the tens minutes and units hours digits position, the logic circuitry disables the hours, the minutes and the colon from being displayed. Thus, the use of the single switch 25, displays both seconds and date information. The dual function of switch 25, reduces the number of switches required by prior art digital watches and substantially reduces the cost of circuit components.

By depressing switch 27, for example, the hour digits are advanced, while the minute information is continuously displayed, for setting the watch to the correct hour of the day. The date is set by depressing switch 29 when the hours information is indicating other than twelve. Minutes are set by manually advancing the hours to twelve by depressing switch 27, and then depressing switch 29 which advances the minutes until the correct time is reached. After the minutes have been set switch 27 is again depressed to advance the hours information to the correct time. Thus, a single switch (29) is required for setting both date and minutes information, whereas prior art watches have required two separate switches to provide the same functions. Again, circuit cost is reduced by the novel features of the watch of the invention.

Another novel feature of the embodiment of the invention occurs while minutes are being set. The logic circuitry disables the clocking signal to memory register circuit 16 to stop time from being continuously kept by the watch. The second units are automatically set to zero and the colon is displayed continuously to indicate that digital watch 10 is not running. By advancing the minute digits to one minute ahead of the actual time, the user can listen, for example, to radio station WWV and, at the time tone, start the watch by depressing switch 27 so that precise time is set. It is to be understood that switches 25, 27 and 29 can either be of the push button type or incorporated into the stem of a watch.

As is well known in the art, crystal control oscillator 12 provides a clocking signal at a frequency of 32.768 KHz. The output frequency from crystal control oscillator 12 is divided by a plurality of flip-flops comprising divider circuit 14 to an output frequency of 1 Hz which is applied over conductor 30 to memory register 16. A 1 Hz clocking signal from divider circuit 14 is also applied to set and display circuit 26 over conductor 32. As will be explained in greater detail, memory register circuit 16 is comprised of a plurality of counter circuits, each of which provide binary coded signals of four bit lengths or distinct groups of data corresponding to seconds, minutes, hours and the date information which are to be displayed on visual display panel 28.

In response to a predetermined number of output signals from divider circuit 14, which have specified frequencies associated therewith, being applied over conductors 34, 36, and 38, phase generator 24 derives multiplex control signals (as will be explained later) for reading and transmitting the distinct groups of data from memory register circuit 16 to decoder 20. Phase generator 24 also derives a second set of multiplex control signals to selectively enable gating latches and driver circuit 22 whereby the binary coded signals of four bit lengths from memory register circuit 16 are decoded into seven segment coded signals which are stored in latches then selectively and continuously displayed on visual panel 28 during predetermined times of the phase cycle generated by phase generator 24.

Figure 2:
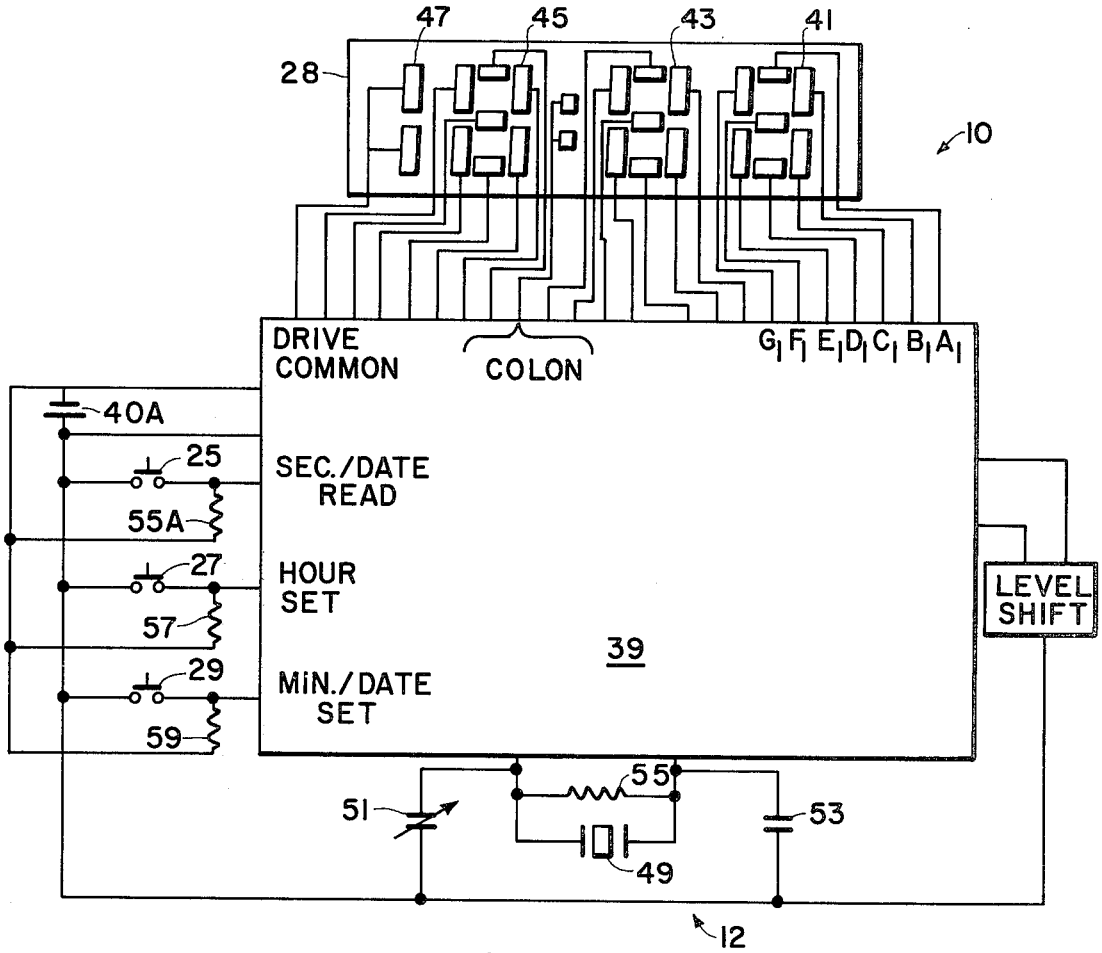
FIG. 2 is a partial block and partial schematic of the digital watch of the present invention.

FIG. 2 illustrates the integrated circuit portions of watch 10, as block 39. Block 39 may be formed of one or several integrated circuit chips using known techniques. In addition to integrated circuit 39, watch 10 comprises battery 40A which supplies power to the components of integrated circuit 39 and to visual display panel 28. Visual display panel 28 is shown as consisting of four liquid crystal displays 41, 43, 45, and 47. Displays 41 and 43 are utilized for displaying unit seconds, tens seconds and unit minutes, tens minutes digits, although not simultaneously. Displays 45 and 47 are used for displaying units hours and tens hours digits. On command, units date and tens date information is displayed on liquid crystal displays 43 and 45 respectively. Level shifting circuitry is included for stepping up the voltage from battery 40A to drive set and display circuit 26.

The external components of oscillator 12 are crystal 49, variable capacitor 51, capacitor 53 and bias resistor 55. Also external to integrated circuit 39, are switches 25, 27 and 29 and bias resistors 55A, 57 and 59 which are connected thereto respectively.

Figure 3:
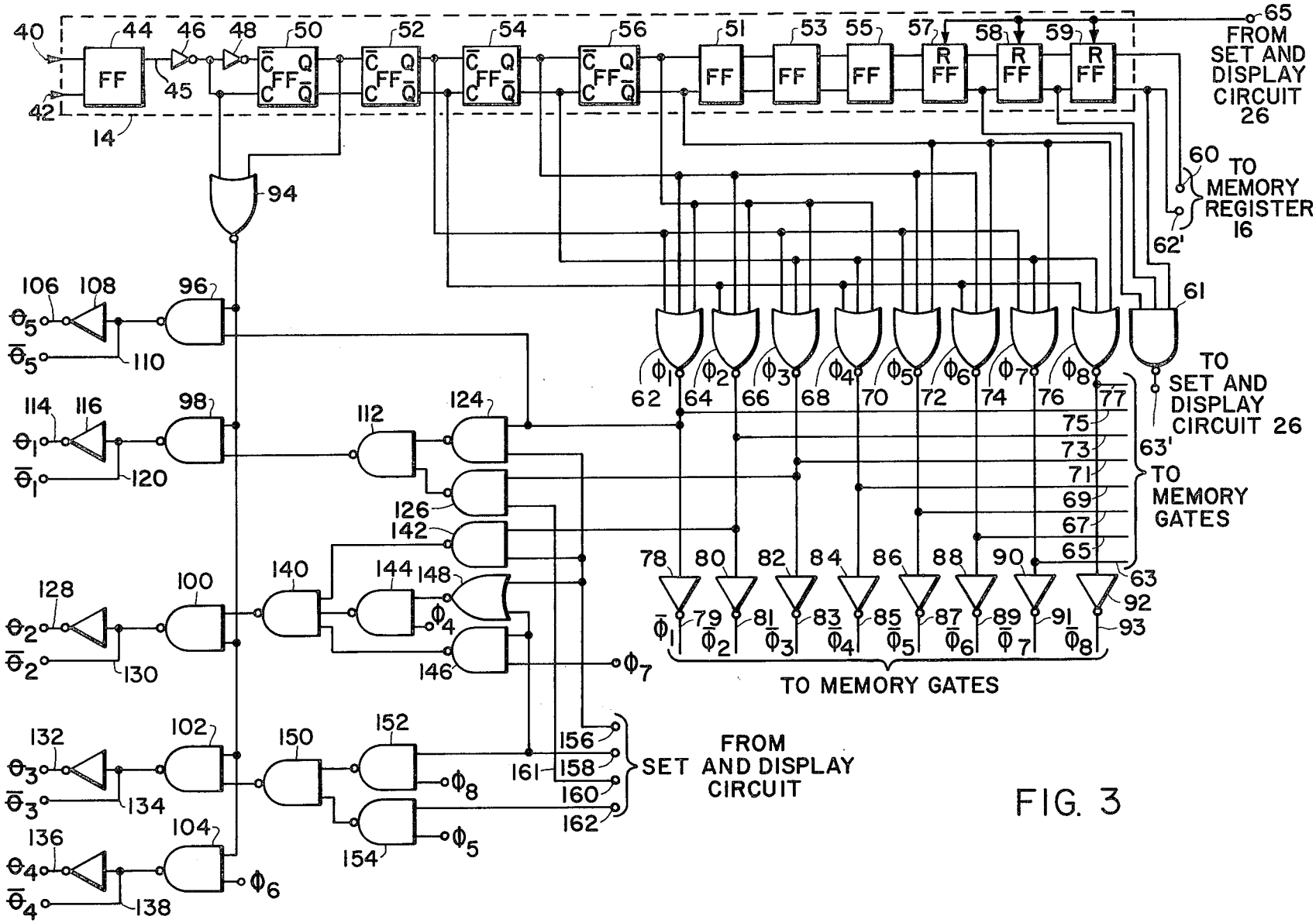
FIG. 3 is a partial block and partial schematic diagram illustrating the phase generator portion of the embodiment of the invention.

Referring to FIG. 3, phase generator 24 of integrated circuit 39 is shown in more detail. The square wave generated by oscillator 12, at a frequency of 32.768 KHz, is applied over conductors 40 and 42 to divider circuit 14. Divider circuit 14 includes a plurality of a first group of binary flip-flops 44, which may be of the MOS complementary symmetry transistor type, to divide the oscillator frequency down to 1.024 KHz. The output of flip-flops 44 is applied over conductor 45 to first inverter 46, with its output being applied to second inverter 48 and to a first input of flip-flop 50. The output of inverter 48 is applied to the second input of flip-flop 50. The outputs of inverters 46 and 48 are considered to be a clocking pulse, as is known in the art, for clocking flip-flop 50, at the 1.024 KHz rate. The output of flip-flop 50, terminals Q and Q, provides a clocking pulse to flip-flop 52 which in turn provides a clocking pulse to the input of flip-flop 54 and so forth to each of the remaining flip-flops of divider 14. Thus, as is known in the art, flip-flops 50 through 59, successively divide the clocking signal in half until the frequency at the output of flip-flop 59 occurs at a 1 Hertz rate at output terminals 60 and 62′ which are applied to memory register circuit 16. The last three flip-flops 57, 58, 59 are of the reset type and have respective outputs to NAND gate 61 for gating a 1 Hz control signal to set and display circuit 26 at terminal 63'. The reset terminals of flip-flops 57, 58 and 59 are connected to set and display circuit 26 at terminal 65 to receive a reset signal therefrom when minutes are to be set, thereby stopping watch 10 as previously discussed. Selected terminals of flip-flops 52, 54 and 56 are also applied to the inputs of NOR gates 62 through 76 in a predetermined order. The outputs of NOR gates 62 through 76 are directly connected to memory gating ciruit 18 and to inverters 78 through 92 which have their respective outputs also connected to memory gating circuit 18. The outputs of NOR gates 62 through 76 are also connected to a plurality of NAND gates as will be discussed.

Phase generator 24 is shown as further including NOR gate 94 having its inputs connected to the output of inverter 46 and to one output of flip-flop 50 and its output being connected to a first input terminal of each of NAND gates 96 through 104. A second input terminal of NAND gate 96 is connected to the output of NOR circuit 62 with its output being connected to terminal 106 through inverter 108 and to output terminal 110. NAND gate 98 is shown as having its other input terminal connected to the output of NAND gate 112 and its output connected to output terminal 114 through inverter 116 and also to output terminal 120. NAND gate 112 has first and second input terminals connected to the outputs of NAND gate 124 and 126 respectively. In a like manner, NAND gates 100, 102 and 104 have their outputs connected to output terminals 128 through 138 respectively. The second input terminal to NAND gate 100 is connected to the output terminal of NAND gate 140 which has a plurality of input terminals connected to NAND gates 142, 144 and 146 respectively. NAND gate 144 has a first input terminal connected to the output of NOR gate 148. NAND gate 102 has a second input terminal connected to NAND gate 150 which has a first and second input terminal connected to NAND gates 152 and 154 respectively. As shown, the outputs of NOR gates 62 through 76 are also connected to NAND gates 124, 142, 126, 144, 154, 104, 146 and 152 respectively. NAND gates 124 and 142 and NOR circuit 148 are shown as being connected to input terminal 156. A second input terminal of NOR gate 148 as well as NAND gates 146 and 152 are connected to input terminal 158. The second input terminals of NAND gate 126 and 154 are respectively connected to input terminals 160 and 162. Input terminals 156 through 162, as will be discussed in detail later, are adapted to receive control signals from set and display circuit 26. Output terminals 106, 110, 114, 120, and 128 through 138 are adapted to be connected to gating and driver circuit 22 for providing phase control signals thereto.

Figure 4:
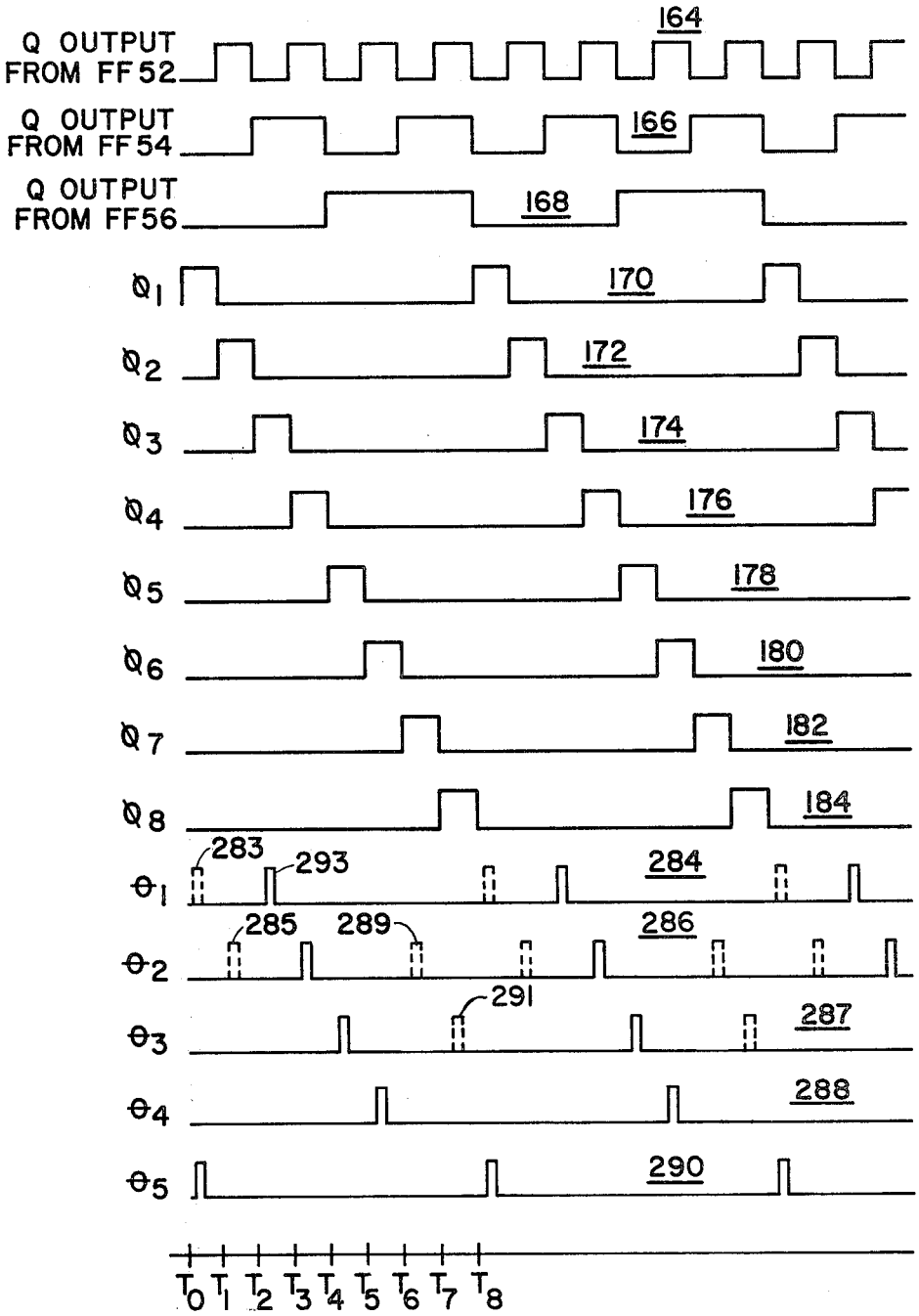
FIG. 4 is a timing diagram useful for explaining the operation of the phase generator of FIG. 2.

Referring to FIG. 4, the operation of a portion of phase generator 24 is explained with the aid of the timing diagram. In response to the clocking signal generated by crystal control oscillator 12, output signals are derived at the output of flip-flops 52, 54 and 56, which occur at the predetermined repetition rates or frequencies, 256 Hertz, 128 Hertz and 64 Hertz respectively, the outputs being connected in a predetermined manner to the inputs of each of the NOR gates 62 through 76 such that at the outputs of the NOR gates, successive cycles are derived having periodic output pulses during predetermined time intervals in each cycle. Each of the periodic pulses have identical pulse widths and repetition rates or frequencies.

For explanation purposes only, the typical operation of NOR gate 66 will be described, it being understood that the remaining NOR gates operate in a similar fashion. As described above and as shown by waveform 164, the output of flip-flop 52 is a square wave having a frequency of 256 Hertz. Waveform 166, the output from flip-flop 54 has a frequency of 128 Hertz and waveform 168 derived at the output of flip-flop 56 has a frequency of 64 Hertz. The three input terminals to NOR gate 66 are connected respectively to the "Q" output terminal of flip-flop 52, "$\overline{Q}$" output terminal of flip-flop 54, and "Q" output terminal of flip-flop 56. For NOR gate 66 to have a binary "1" at its output terminal, a binary "0" must be applied to all three input terminals thereof. By observing waveforms 164, 166 and 168, the input signals to NOR gate 66 will be zero only during the time period from T2 to T3 (the "$\overline{Q}$" output from flip-flop 54 being the complementary of the "Q" output signal therefrom). Thus, there will be an output pulse from NOR gate 66 only between times T2 and T3, waveform 174, at all other times between T=0−T8 the output of NOR gate 66 is zero. The pulse width of output signal $\phi 3$ is equal to that of waveform 164 which is equal to 1/256 seconds, the repetition rate of $\phi 3$ being equal to 1/256 seconds, the repetition rate of $\phi 3$ being equal to 1/64 seconds. In a like manner, memory gating phase control signals $\phi 1$–$\phi 8$ are generated in sequential timing intervals of the timing cycle of phasing generator 24. The complement of the output phase signals $\phi 1$–$\phi 8$ are derived at the outputs of inverters 78 through 92 such that, for example when $\phi 1$ is equal to the binary number "1", $\phi 1$ is equal to the binary number "0" and vice versa. Phasing control signals $\phi 1$–$\phi 8$ are applied over conductors 63 through 77 respectively along with complementary signals $\phi 1$–$\phi 8$ over conductors 79 through 93 respectively to memory gating circuit 18, the operation of which will be explained in greater detail hereinafter.

Figure 5A:
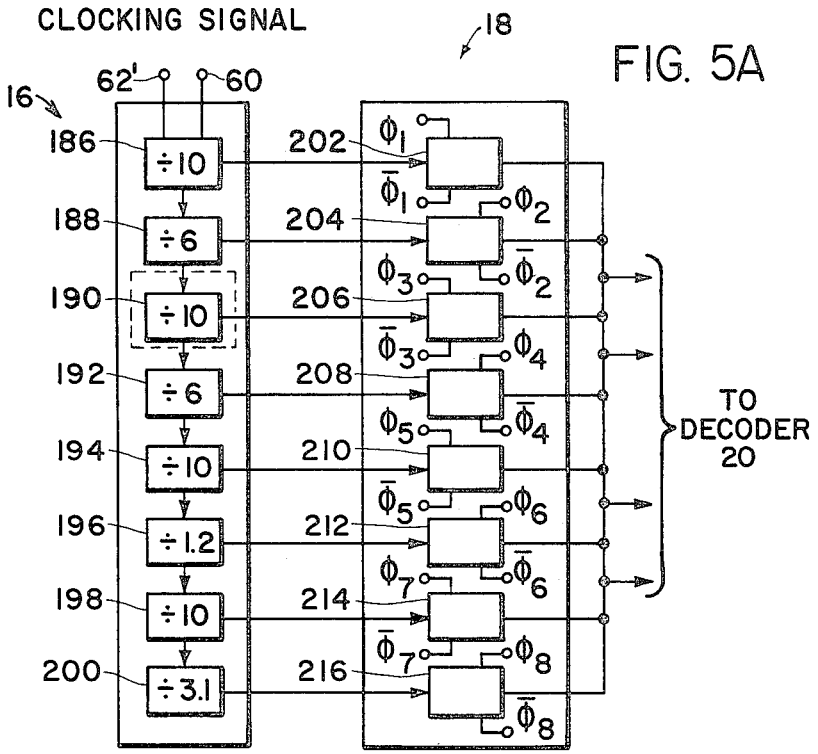
FIG. 5A is a block diagram illustrating in greater detail the memory gating circuitry and memory register circuitry of FIG. 1.
Figure 5B:
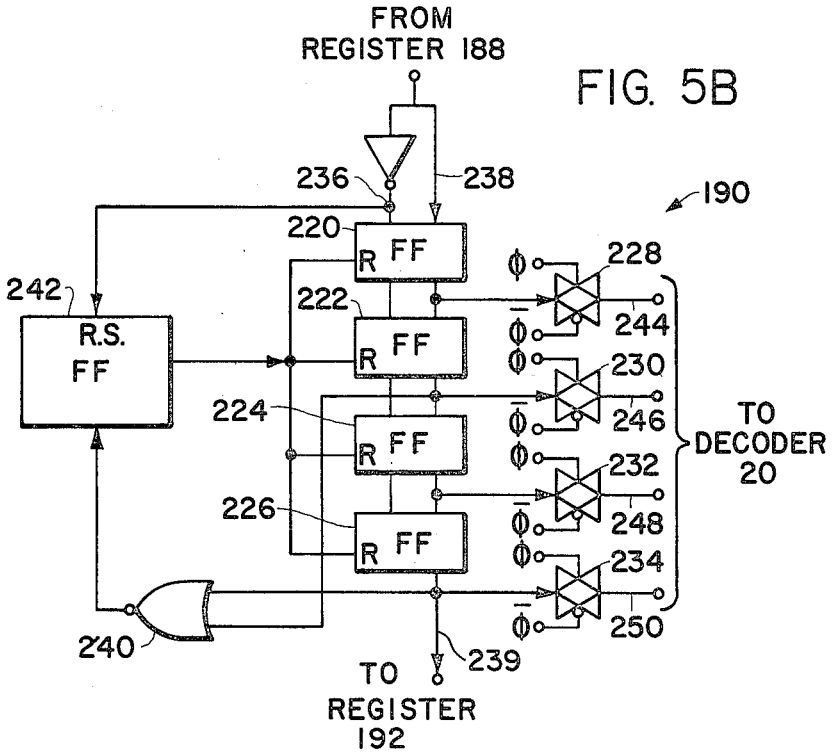
FIG. 5B is a schematic diagram illustrating a typical counter or register circuit included in memory register circuit as shown in FIG. 1.

Referring to FIGS. 5A and 5B, memory register circuit 16 of integrated circuit 39 is illustrated as comprising a plurality of counters 186 through 200.

The 1 Hz clocking signal appearing at terminals 60 and 62' are applied to seconds units register, counter 186, which divides by 10 and whose output is in turn connected to seconds ten register 188 which divides by 6. The seconds tens register in turn has its output connected to minutes unit register 190 which again divides by 10 and the output of this register is connected to minutes ten register 192 which divides by 6. The output of register 192 is connected in turn to hours unit register 194 which also divides by 10 and which has its output connected to hours tens register 196. Register 196 divides by 1.2 and has its output connected to days unit register 198, which divides the input signal by 10. The output of register 198 is connected to days tens register 200 which is a divide by 3.1 counter. It is understood that an AM/PM indicator could be provided by dividing the output from register 196 by 2. The memory registers 186–200 are all comprised of binary chains of complementary MOS transistor pairs and the individual stages are identical to individual stages of divider 14. As is well known in the art, each of the individual counters divide the input clocking signal applied thereto and store this information until the next clocking pulse is applied thereto. The stored information is in the form of a four bit binary coded signal which represents a binary number. Memory gating circuit 18 is illustrated as comprising a plurality of MOS complementary transmission gates 202–216, each individual transmission gate being connected to individual registers 186–200 respectively.

Typical counter circuit 190 and transmission gate 206, associated therewith, are shown in FIG. 5B, which for example may be the register for storing and transmitting minutes data information. Minutes register 190 includes a plurality of toggle flip-flops serially connected with the complementary output terminal of each flip-flop 220 through 226 being connected respectively to the input of transmission gates 228 through 234. The input clock pulse to register 190 is applied over conductors 236 and 238 from previous register or counter 188, the clocking signal occurring at a repetition rate of one cycle per minute. The complement Q output of flip-flop 226 of counter 190 is also applied to the input of the next counter or register 192 over conductor 239 and is also returned to one input terminal of NOR gate 240. The other input terminal of NOR gate 240 is connected to the complementary output terminal of flip-flop 22. The output of NOR gate 240 is applied to the input of RS flip-flop 242 which has its output connected to the R input terminals of flip-flops 220–226 of counter 190. As counter 190 is known in the art, only a brief description of its operation is required. In response to the clocking pulse applied to input terminals 236 and 238, binary coded signals are generated by counter 190 representing the integers zero through nine. Therefore, in response to nine successive clock pulses, the binary numbers 0 through 9 will have been counted through register 190. As the tenth clock pulse is applied to input terminals 236 and 238, NOR gate 240 is gated on for resetting flip-flop 242 such that the binary coded number appearing at the outputs of counter 190 will be zero and the clocking period begins over. In between each clocking pulse, the binary coded number is stored in flip-flops 220 through 226, the number being advanced in response to the next clock pulse. Thus, at any particular instance, a binary coded number which is represented by "0's" and "1's" are applied to transmission gates 228 through 234. In response to a predetermined phase control signal, for example, phase $\phi 3$ and $\overline{\phi 3}$ which are generated by phasing generator 24, as previously discussed, transmission gates 228 and 234 are rendered conductive for transferring the binary coded information to BCD to 7 segment decoder 20. In a like manner, the data information stored in individual counters 186 through 200 are transmitted to binary to BCD to 7 segment decoder in successive cycles in a multiplex mode of operation, i.e., as phasing control signals $\phi 1$ through $\phi 8$ and their complements appear on respective transmission gates 202 through 216 at different predetermined times during each cycle, the binary coded information representing seconds, minutes, hours and the date are selectively applied to decoder 20 over common conductors 244 through 250. Referring to FIG. 4, the units second data information is applied to decoder 20 during the time segment from T=0 to T1, the tens seconds information between time T1 and T2, units minutes information between time T2 and T3, the tens minutes information between times T3–T4, and so forth.

Figure 6:
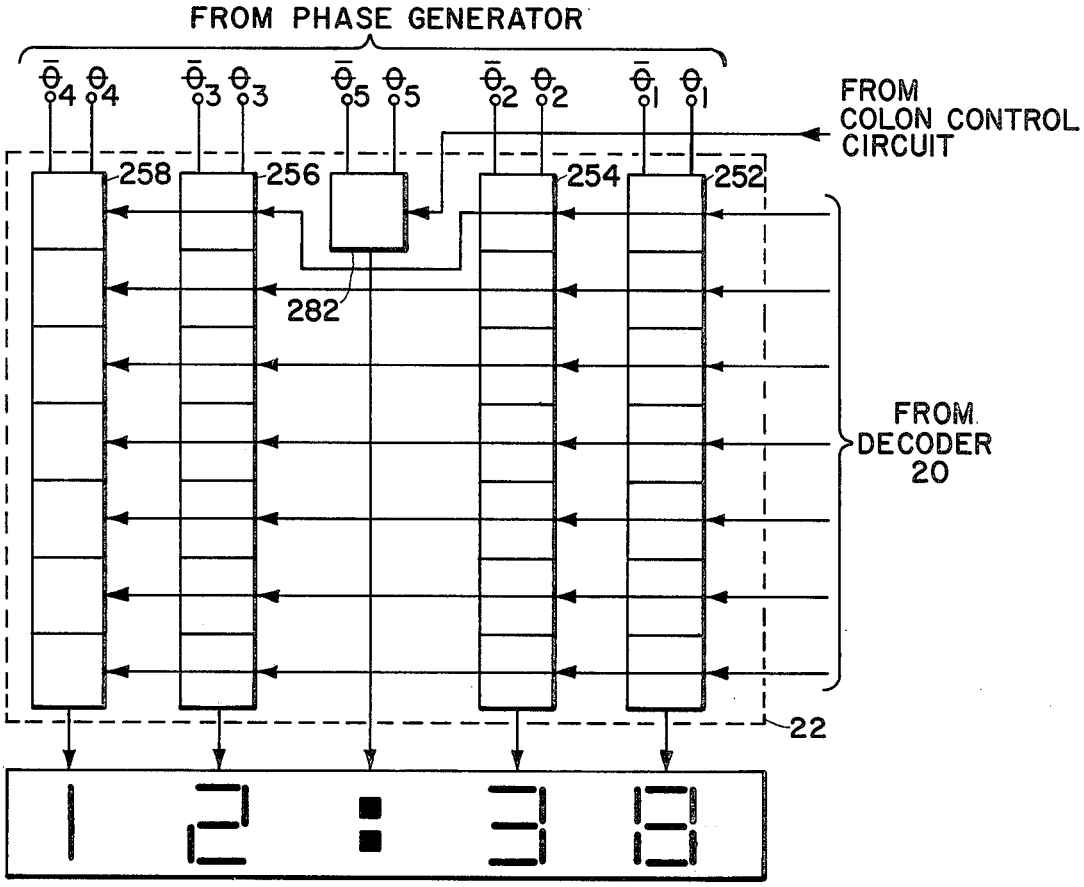
FIG. 6 is a block diagram showing in greater detail the gating and driver circuit of FIG. 1.

In a well known manner decoder 20 converts the binary coded data from memory register circuit 16 into control signals for energizing selected ones of the 7 segment characters to be displayed on visual display panel 28. The control signals from decoder 20 are applied in parallel to gating and driver circuit 22 comprising individual latch drivers 252 through 258, as illustrated in FIG. 6.

Figure 7:
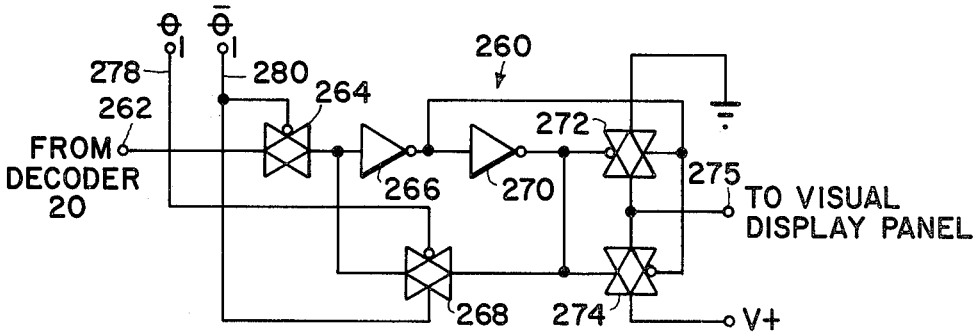
FIG. 7 is a schematic diagram illustrating a single segment latch driver circuit of the gating and driver circuit of FIG. 1.

As illustrated in FIG. 7, each latch driver circuit includes a plurality of individual segment latch driver circuit 260 for receiving the data information from decoder 20 at input terminal 262 thereof. Segment latch driver circuit 260 comprises transmission gate 264 adapted to receive the input signal applied to input terminal 262 and having its output terminal connected to inverter 266 and to a second transmission gate 268. The output of inverter 266 is applied to inverter 270 and to an input control terminal of transmission gate 272 and transmission gate 274. The output of inverter 270 is applied to a second input control terminal of transmission gates 272 and 274. Input terminal 278 of segment latch driver 260 is adapted to receive a latch driver phasing control signal (as will be explained later) and is connected to a first input control terminal of transmission gate 264 and a second input control terminal of transmission gate 268. Input terminal 280, adapted to receive the complementary signal of the latch driver phasing control signal which is applied to input terminal 278, is connected to a second input control terminal of transmission gate 264 and a first input control terminal to transmission gate 268. The particular segment of a digit of visual display panel 28 which is to be either energized or blanked is connected to the interconnected output terminals of transmission gates 272 and 274 at terminal 275, with the input of transmission gate 272 being connected to a ground terminal and the input to transmission gate 274 being connected to a voltage bias supply.

By way of example, assume that a selected segment of a number is to be displayed during that portion of the cycle at which counter 190 of memory register circuit 16 is providing data to decoder 20. A latch phasing signal, $\theta 1$, is then applied to input terminal 278 of each individual segment latch driver circuit 260 comprising latch driver circuit 252 such that the input is at a logic "1" level. Input terminal 280, will then be at a logic "0". Thus, transmission gate 264 will be rendered conductive and will pass the segment control signal applied to input terminal 262 from decoder 20 to inverter 266. If the segment is to be energized, the signal applied to input terminal 262 will be a logic "1" and thus the output of inverter 266 will be a logic "0". Transmission gate 274 is rendered conductive which connects the segment, for example, A1 of liquid crystal display digit 41 of visual display panel 28 to the voltage supply and that segment is then energized. However, if at the time that $\theta 1$ is at a logic "1", the particular segment is not to be energized, the input signal at input terminal 262 will be a logic "0" and is transmitted through transmission gate 264 to inverter 266 which then inverts the signal to a logic "1" to render transmission gate 272 conductive and transmission gate 274 nonconductive. As transmission gate 272 is rendered conductive, the particular segment of the visual display panel is then connected to the ground terminal of the circuit and is not energized. Therefore, the particular segment will not be displayed. Latch driver circuit 282 which is driven by a colon drive circuit and which includes a single segment latch driver circuit 260 is selectively energized at a 1 Hertz repetition rate for displaying the colon once every second during normal operation of the watch, as is illustrated in FIG. 4. That is, each time phasing control signal $\theta_5$ (waveform 290) is positive during time interval T=0 to T1, when the 1 Hz signal from flip-flop 59 appears at the colon drive circuit.

Each of the individual segment latch driver circuits 260 of a particular latch driver circuit, for example latch driver circuit 252, are gated in a transmission mode for passing the seven segment signal from decoder 20 by the latch driver phasing control signals $\theta 1$ through $\theta 5$ and their complements. Thus, at the same time during the timing cycle ($\phi 3$) at which units minutes register 190 transfers the units minutes data information through memory gating circuit 18 to decoder 20, control signal $\theta 1$ and its complements is applied to the individual segment latch drivers 260 of latch driver circuit 252 such that the units minutes data information is displayed on visual display panel in a manner as explained above. During the next time interval (T3 through T4) the tens minutes data information from register 192 is transferred through memory gating circuit 18 to decoder 20 and is displayed on visual display panel 28 when latch driver circuit 254 is gated on by latch driver phasing control signal $\theta 2$ and its complement.

The minutes information will be stored and continuously displayed until the next occurrence of $\theta 1$ and $\theta 2$ latch phasing control signals during times T2–T3 and T3–T4 respectively of the next timing cycle. In response to the next occurrence of $\theta 1$ and $\theta 2$, minutes information will be updated, i.e., if the minutes information has changed this change will then be displayed when $\theta 1$ and $\theta 2$ are present. However, with no change in information, no change will occur on the display panel.

Referring back to FIG. 3 and FIG. 4, the operation of phase generator 24 for generating latch driver phasing signals $\theta 1$ through $\theta 5$ is now explained. For brevity, the generation of phasing control signal $\theta 1$ during the timing control cycle, interval T2–T3, will be explained, it being understood that the generation of the other phasing control signals $\theta 2$–$\theta 5$ occur in a like manner. This, in response to first phasing control signal, $\phi 3$, a logic "1", is applied to one input terminal of NAND gate 126. In normal mode of operation of watch 10, as will be explained later, input terminal 160 has a logic "1" applied thereto from set and display circuit 26 which is applied over conductor 161 to the other input terminal of NAND gate 126 such that the output of NAND gate 126 goes to a logic "0". Therefore, NAND gate 112 having a logic "0" applied to one of its input terminals derives a logic "1" at its output terminal which is connected to NAND gate 98. The other input to NAND gate 98 is clocked between a logic "1" and "0" at a repetition rate of 512 Hertz by the gating of NOR gate 94. As illustrated in FIG. 4, waveform 284, an output pulse 293 is derived between time periods T2 and T3 corresponding to latch driver phasing control signal $\theta_1$. It will be apparent to those skilled in the art, that the pulse width of output pulse 293 is 1/1,024 seconds, the beginning of the pulse being delayed during the first quarter of the phasing control signal $\phi 3$ and ending before the last half of the phasing control signal $\phi 3$. Thus, the individual segment latch drivers of latch driver circuit 252 are delayed from being strobed on to ensure that data information is present on the inputs of the segment latches from decoder 20 and are rendered nonconductive before the data transformation is completed in order to eliminate any noise which might be associated with the trailing edge of the data information.

As briefly discussed above, during normal mode of operation of the digital watch, hours and minutes are displayed. Therefore, latch driver phase control signals $\theta 1$ through $\theta 4$ occur during time intervals T2 through T6 which correspond to phasing control signals $\phi 3$ through $\phi 6$ gating the minutes and hour data information through decoder 20 to latch display drivers 252 through 258. During normal operation, the seconds data information which would be gated through decoder 20 onto latch drivers 252 and 254 to appear at time interval T=0–T2 is prevented from normally being displayed by causing $\theta 1$ and $\theta 2$ to be zero (phantom waveforms 283 and 285) as phasing control signals $\phi 1$ and $\phi 2$ are gating the seconds data information through decoder 20, as illustrated by waveforms 284 and 286. Also, data information is normally prevented from being displayed through latch drivers 254 and 256 to visual display panel 28 by causing latch driver phasing control signals $\theta 2$ and $\theta 3$ (waveforms 289, 291) to be zero during the time intervals T6 through T8 during which phasing control signals $\phi 7$ and $\phi 8$ are transferring date information through decoder 20 to the latch driver circuits. However, latch driver circuit 282 is normally rendered conductive to display the colon indicia at a 1 Hertz rate by causing latch driver phase control signal $\theta 5$ to be high during phase control signal time interval T=0–T1 as shown by waveform 290 of FIG. 4.

Figure 8:
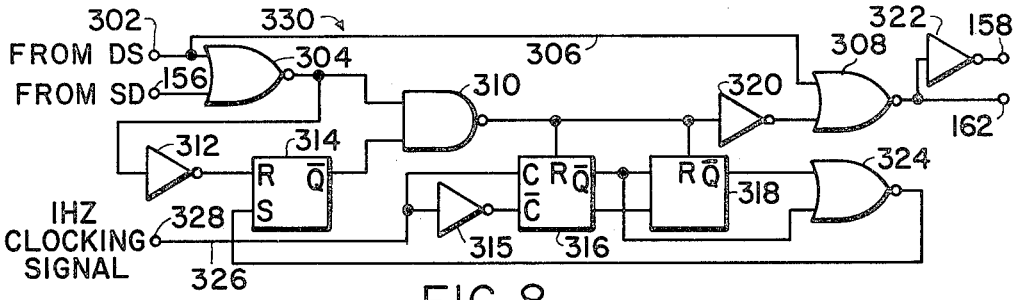
FIG. 8 is a schematic diagram illustrating in greater detail, a portion of the set and display circuit of FIG. 1.
Figure 9:
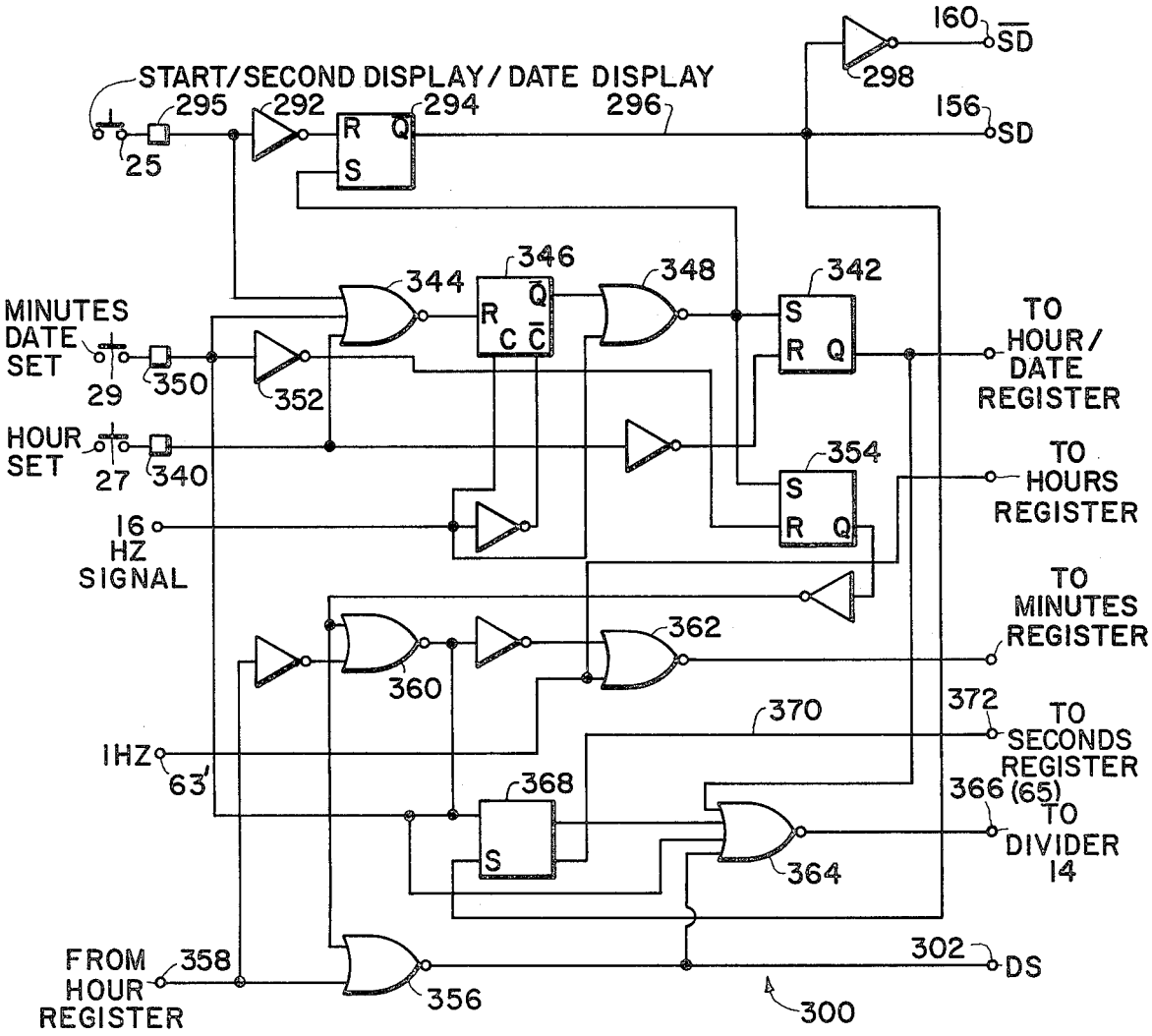
FIG. 9 is a schematic diagram illustrating in greater detail, the display circuitry of the set and display circuit of FIG. 1.

Referring to FIGS. 8 and 9, the operation of set and display circuit 26 for controlling the display of seconds and date information as well as for setting time information is explained. During normal operation of watch 10, switches 25, 27, 29 are opened, preventing bias from being applied therethrough.

With seconds date display switch 25 open, a logic "0" is generated by inverter 292 and RS flip-flop 294 and applied over conductor 296 to inverter 298 and terminal 156, illustrated as the $\overline{SD}$ (seconds demand) terminal. Inverter 298 inverts the signal applied thereto and derives a logic "1" at output terminal 160, the SD terminal. As previously discussed, with both a logic "1" being applied through terminal 160 and a logic "0" being applied at terminal 156 to the latch driver phasing control portion of phase generator 24, seconds information is not displayed.

Further, the output from terminal 156 or the SD terminal is directly applied to display command circuit 330 of FIG. 8 at one input of NOR gate 304 with the other input terminal connected to terminal 302 of set circuit portion 300 which is also at a logic "0" during normal operation of watch 10. Display circuit 330 consisting of inverters 312, 315, 320, 322, NOR gates 308, 324, NAND gate 310, RS flip-flop 314 and reset registers 316, 318, will therefore have a logic "0" derived at terminal 158 and a logic "1" at output terminal 162 thereof. Thus, latch driver phasing control signals $\theta 2$ and $\theta 3$ are disabled during time intervals T6–T8 respectively. Registers 316 and 318 are prevented from clocking the 1 Hz signal applied over conductor 326 from input terminal 328 as they are in a reset condition, having a reset signal applied thereto from NAND gate 310.

Operation of the seconds switch 25 applies a bias voltage which is adjusted in level by level shifter 295 of set command circuit 300. In response, RS flip-flop 294 changes states causing the control signals at output terminals 156 and 160 to also change states. Thus, latch driver phasing control signals $\theta 1$ and $\theta 2$ are caused to be high during time intervals T=0–T1, and T1–T2 respectively for displaying seconds information. The output signals at output terminals 158 and 162 remain unchanged preventing date information from being displayed. However, with SD output terminal being at a logic "1", the minutes information is prevented from being displayed, as latch phasing control signals $\theta 1$ and $\theta 2$ are disabled during time intervals T2–T3, and T3–T4, respectively. During time intervals T4–T5 and T6–T7, a blanking generator (not shown) operates in a known manner to supply a dummy signal to decoder 20 which causes latch drivers 256 and 258 to be disabled whereby digits 45 and 47 of visual display panel 28 are blank. Thus, hours information is not displayed.

Upon release of seconds command switch 25, date information will be momentarily displayed, as will now be discussed. With switch 25 being returned to an open, as described above, the control signals at output terminals 156 and 160 are respectively returned to "0" and "1". This change in state of voltage at the input of NOR gate 304 of display circuit 330 causes RS flip-flop 314 to change state which enables NOR gate 308 to cause the voltage at terminal 158 to go to a "high" level and the voltage at terminal 162 to become "low". Thus, latch driver phasing control signals $\theta 2$ and $\theta 3$ are caused to go high during time intervals T6–T7, and T7–T8 respectively, for displaying date information which is supplied to latch drivers 254 and 256 when information is caused to be transferred thereto by the control signals $\phi 7$ and $\phi 8$. Minutes and hour information are prevented from being displayed $\theta 1$–$\theta 4$ being disabled during the respective time interval.

Date information will be momentarily displayed until RS flip-flop 314 is reset by NOR gate 324, at which time the voltages at output terminals 158 and 162 return to a normal state. RS flip-flop 314 is disabled from being reset for approximately three seconds due to the enabling of clocking registers 316 and 318, which receive a 1 Hz clocking signal over conductor 326.

Operation of the hours-set switch 27 applies a level shifted bias voltage through level shifter 340 to RS flip-flop 342 which disables the date registers from clocking and for gating the 1 Hz clocking signal from NAND gate 61 (FIG. 3) and terminal 63' to the hours registers. Thus, hours registers 194 and 196 are advanced at a 1 Hz rate for setting thereof. The bias voltage is also applied to NOR gate 344 which in conjunction with RS flip-flop 346 and NOR gate 348, are clocked at a 16 Hz rate by the signal from flip-flop 53 so that the hour registers are enabled at the same repetition rate. This configuration provides an "antibounce" switch, when the hours registers are advanced by the 1 Hz signal.

Operation of the minutes/date-set switch 29 applies a level shifted reset voltage through level shifter 350 and "antibounce" switch comprising; inverter 352, NOR gate 344, flip-flop 346, NOR gate 348 and RS flip-flop 354. The output state of RS flip-flop 354 is therefore changed whereby a logic "1" is maintained at the "Q" output thereof which is inverted with a logic "0" applied to NOR gate 356.

At all hour settings other than twelve, a logic "0" is applied at terminal 358 (from the hours registers) to the other input of NOR gate 356 which will then cause the output of NOR gate 356 to become a logic "1". The output signal of NOR gate 356 is applied at terminal 302 (DS) which causes the voltage at terminal 158 of display circuit 330 to go "high". In response, latch driver phasing control signals $\theta 2$ and $\theta 3$ are allowed to energize displays 45 and 47 during time intervals T6–T7 and T7–T8 respectively, so that the date information is displayed. Simultaneously, with the voltage at terminal 302 being "high", the 1 Hz signal from terminal 61 is applied to the date registers for advancing the date at a 1 Hz rate while being displayed. As previously described, the blanking register is again enabled to provide the dummy signal to blank out the liquid crystal displays during the timing cycle at which minutes and ten hours information would normally be displayed.

To set minutes, the hour set switch is operated so as to advance the hours setting to twelve and then the switch is released. With the hours setting at twelve, a logic "1" is applied at terminal 358 which causes the output of NOR gate 356 to go to a logic "0", thus, disabling the date demand circuit 330 to prevent the seconds and the date information from being displayed. Because both inputs to NOR gate 360 are now low, an enabling signal is provided at the output thereof for diverting the 1 Hz signal from terminal 63' through NOR gate 362 for advancing the minutes registers at a 1 Hz rate. Operation of the minutes-set switch also applies a bias voltage to one input of NOR gate 364 the output of which is connected via terminal 366 to flip-flops 57–59 which generate the 1 Hz signal at terminal 63'. The minute-set switch also applies a reset impulse through RS flip-flop 368 over conductor 370 and terminal 372 which resets seconds counters 186 and 188 to zero in a known manner. In this way, the seconds registers are automatically zeroed when the minutes are set. Simultaneously, the colon display circuit, well known in the art, is rendered operative so that the colon is continuously displayed. Therefore, when minute-set switch is released, watch 10 is not running until the seconds/date demand switch is operated, flip-flops 57–59 being in an inhibited condition as the output from NOR gate 364 is "high".

As previously discussed, when seconds switch 25 is operated, the output at terminal 156 goes high, which will set flip-flop 368 enabling the output of NOR gate 364 to go "low" which removes the inhibiting control signal to flip-flops 57–59. Thus, watch 10 is in a running mode once again.

It is apparent from the above that the present invention provides an improved digital watch. By combining several functions, for example, the command for displaying first seconds and then date, provides for a less complex integrated circuit than prior art liquid crystal display watches. Also, the utilization of a phasing generator for multiplexing and time sharing of timing signals requires the use of only one decoder whereas prior art watches require several decoders to be used. Thus, circuit complexity is greatly reduced which directly reduces manufacturing costs of the watch of the present invention. Another important feature of the invention includes multi-functioning switches for displaying and setting time information which also reduces circuit complexity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embodied therein.

What is claimed is:

1. A digital watch including seconds, minutes, hours, and date time keeping registers for providing a timing operation such that hours and minutes information is both continuously updated and visually displayed, the improvement comprising:

first switch circuit means responsive to an user caused first demand signal for both starting the timing operation and for causing seconds information to be displayed upon command, said first switch circuit means being responsive to the termination of said first demand signal for causing date information to be sequentially displayed for a predetermined time interval;

second switch circuit means responsive to an user caused second demand signal for setting hours information upon command; and third switch circuit means responsive to an user caused third demand signal for setting both minutes and date information upon command.

2. The watch of claim 1 wherein said third switch circuit means is responsive to the hours register being at a predetermined setting to cause minutes information to be set and said third switch circuit means being responsive to the hours register setting being at any other setting than said predetermined setting to cause said date information to be set.

3. The watch of claim 2 wherein during setting of said minutes information said third switch circuit means causes the seconds time keeping register to be reset to zero and the other time keeping registers to be inhibited from advancing until said first switch circuit is rendered responsive to start the timing operation whereby the watch can be set to a precision time standard.

4. A timekeeping circuit suitable to be fabricated in monolithic integrated circuit form including a frequency divider circuit having a plurality of stages for sequentially dividing the frequency of a base timekeeping signal which is applied thereto, a memory circuit having a plurality of clocking registers for producing time information signals representative of at least seconds, minutes and hours in response to a timing signal being applied thereto from the frequency divider circuit, a decoder circuit coupled to the memory circuit which receives the time information signals for producing a plurality of segment drive signals which are utilized to energize selective segment of a visual display circuit having a plurality of segmented digits, the visual display circuit being coupled to respective outputs of the timekeeping circuit, the improvement comprising:

control circuit means coupled to selected stages of the frequency divider circuit for generating first and second sequential gating signals at respective outputs, said first sequential gating signals being utilized to cause the time information signals to be supplied to the decoder circuit in a multiplex mode of operation;

latch driver circuit means including a plurality of individual segment latch driver means each receiving respective ones of said second sequential gating signals from said control circuit and the segment drive signals from the decoder circuit which are utilized to provide drive signals at respective outputs of the latch driver circuit means for driving respective segments of the digits of the visual display circuit, said individual segment latch driver means being responsive to said respective one of said second sequential gating signals being applied thereto such that the segment drive signal appearing at the respective input thereof is transferred and stored in said individual latch driver means whenever said respective one of said second sequential gating signal is applied thereto to cause hours and minutes information to be continuously displayed and updated during normal operation.

5. The time keeping circuit of claim 4 wherein said control circuit includes set and display circuit means adapted to receive a plurality of applied control voltages to vary the operation of the time keeping circuit upon demand, said set and display circuit means being responsive to a first control signal for causing seconds information to be displayed during the duration of said first control signal, said set and display circuit means being responsive to the removal of said first control signal for causing date information to then be displayed for a predetermined duration after which the time keeping circuit is caused to be returned to the normal mode of operation.

6. The time keeping circuit of claim 5 wherein said set and display circuit means is responsive to a second control voltage for manually updating the hours information at a predetermined rate so that hours information is thereby set to a predescribed time.

7. The time keeping circuit of claim 6 wherein said set and display circuit means is responsive to a third control voltage for updating and setting minutes information when the hours information is registering a predetermined hour and for updating and setting date information whenever the hour information is registering any hour other than said predetermined hour.

8. The time keeping circuit of claim 7 wherein said set and display circuit means is further responsive to said third control voltage for setting the seconds time keeping register to zero and disabling all time keeping register when said minutes information is updated, said set and display circuit means then being responsive to a start signal for enabling all of said time keeping circuits.

9. An electronic timekeeping circuit having a plurality of output terminals which are suitable to be coupled to a visual display device for displaying horological information, comprising in combination:

timekeeping circuit means;

circuit means coupled to said timekeeping circuit means;

control circuit means coupled to said timekeeping circuit means and to said circuit means for providing a plurality of sets of sequential control signals;

said timekeeping circuit means being operable for continuously generating a plurality of sets of horological information;

said timekeeping circuit means being responsive to first ones of said plurality of sets of sequential control signals from said control circuit means for transferring signals representative of said plurality of sets of horological information to said circuit means in a multiplex mode; and said circuit means being responsive to second ones of said sets of sequential control signals from said control circuit means in a normal mode of operation for receiving and storing and signals representative of said horological information and being periodically updated by the same to continuously maintain and update the output terminals of the timekeeping circuit at output signal levels representative of predetermined ones of said sets of horological information such that said predetermined sets of horological information are continuously visually displayed.

10. The electronic timekeeping circuit of claim 9 wherein said timekeeping circuit means includes:

an oscillator for providing a base timekeeping signal having a fundamental frequency;

divider circuit means coupled to said oscillator for successively dividing said frequency of said base timekeeping signal to provide a continuous clocking signal having a predetermined repetition rate; and counter means coupled to said divider circuit means and being responsive to said clocking signal for providing said plurality of sets of horological information at respective outputs therefrom.

11. The electronic timekeeping circuit of claim 10 wherein said circuit means includes;

decoder means coupled to said respective outputs of said counter means, said decoder means providing a plurality of decoded segment output signals at outputs thereof in response to said sets of horological information being applied thereto from said counter means, said segment output signals being representative of said sets of horological information; and latch-driver circuit means coupled to said outputs of said decoder means for receiving said decoded segment signals and for storing updating said segment signals when activated by said control circuit means to provide said output signal levels representative of said predetermined ones of said sets of horological information.

12. The electronic timekeeping circuit of claim 11 wherein said divider circuit means includes a plurality of outputs and said control circuit means includes:

first logic circuit means responsive to selected outputs from said divider circuit means for providing first gating signals for causing said sets of horological information to be sequentially supplied to said decoder means; and second logic circuit means responsive to selected outputs from said divider circuit means and to said first logic circuit means for providing second gating signals for activating said latch-driver circuit means such that said horological information from said decoder means is demultiplexed whereby said output signal levels representative of predetermined ones of said sets of horological information are provided and maintained from said latch-driver circuit means.

13. The electronic timekeeping circuit of claim 12 wherein said first logic circuit means further includes:

set and display circuit means for providing first output signals to said second logic circuit means which in conjunction with said first gating signals cause said representative output signal levels from said circuit means to be continuously provided when said electronic timekeeping circuit is in a normal mode of operation, said set and display circuit means being responsive to a display demand signal being applied thereto for providing second output signals to cause said circuit means to maintain the output terminals at output signal levels representative of another one of said sets of horological information during the duration of said demand signal, said set and display circuit means being responsive to the removal of said display demand signal for providing third output signals of a predetermined duration such that said circuit means maintains the output terminals at output signal levels representative of yet another one of said sets of horological information only during the time duration of said third output signals, said set and display circuit means providing said first output signal level after the termination of said third output signals.

14. The electronic timekeeping circuit of claim 13 wherein said set and display means is responsive to a first set demand signal being applied thereto for sequentially advancing first ones of said output signal levels representative of said predetermined sets of horological information which are provided at the outputs of the timekeeping circuit, said set and display circuit being responsive to a second set demand signal being applied thereto when said first ones of output signal levels are indicating a predetermined time setting for causing second ones of said output signal levels representative of predetermined sets of horological information to be sequentially advanced and for causing said output signal levels of yet another one of said sets of horological information to be sequentially advanced when said first ones of said output signal levels are at any setting other than said predetermined time setting.

15. The timekeeping circuit of claim 14 wherein said another one of said sets of horological information are caused to be advanced to an initial time setting when said second ones of said output signal levels is being advanced in response to said second set demand signal.

16. The timekeeping circuit of claim 9 wherein said control circuit means is responsive to an applied command signal for producing third sets of sequential control signals said circuit means being responsive to said third sets of sequential control signals from said control circuit means for maintaining the output terminals at output signal levels representative of other ones of said sets of horological information generated by said timekeeping circuit means.

17. A digital watch for displaying timing information, comprising in combination:

at least one visual display device having a plurality of individual display locations;

first circuit means for providing timing information, said first circuit means including an oscillator, divider means having a plurality of outputs being coupled to said oscillator for successively dividing the frequency of the output signal of said oscillator to provide a timing signal, and counter means receiving said timing signal for providing a plurality of time information signals in a first form at respective outputs;

decoder circuit means responsive to said time information signals being applied thereto from said first circuit means for providing at outputs thereof time information signals being in a second form;

bus means for coupling said respective outputs of said first circuit means to said decoder circuit means;

latch-driver circuit means receiving said time information signals from said decoder circuit means for both storing the same and continuously providing driving signals representative of said time information signals to respective ones of said visual display locations; and control circuit means coupled to said first circuit means and said latch-driver circuit means for providing first and second sets of sequential control signals, said first set of sequential control signals being utilized for transferring said time information signals in a first form from said counter means to said decoder circuit means in a multiplex mode of operation, said second set of sequential control signals being utilized to gate said latch-driver circuit means for demultiplexing said time information signals of a second form into said latch-driver circuit means such that said time information signals are continuously stored and updated so only predetermined sets of said timing information signals are continuously displayed and updated in the normal mode of operation of the digital watch.

18. The digital watch of claim 17 wherein said control circuit means includes:

a first logic circuit coupled to selected outputs of said divider means and being responsive to respective signals applied thereto from said divider means for providing said first sets of control signals;

a second logic circuit for providing first output signals therefrom during normal operation of the digital watch; and a third logic circuit coupled to selected outputs of said divider means and being responsive to respective signals from said divider means, to said first set of control signals from said first logic circuit and to said first output signals from said second logic circuit to provide said second set of control signals.

19. The digital watch of claim 18 wherein said second logic circuit is responsive to a first set demand signal being applied thereto for causing a first subset of said sets of timing information being continuously displayed to be advanced to a desired time.

20. The digital watch of claim 19 wherein said second logic circuit is responsive to a display demand signal being applied thereto for providing second output signals which are utilized for causing second predetermined sets of time information signals to be displayed on said visual display device, said second logic circuit providing third output signals for a predetermined duration upon removal of said display demand signal, said third output signal being utilized for causing third predetermined sets of time information signals to be displayed on said visual display device, said first output signals being provided by said second logic circuit upon termination of said third output signals.

21. The digital watch of claim 20 wherein said second logic circuit is responsive to a second set demand signal being applied thereto for providing fourth output signals which are utilized for advancing a second subset of said predetermined sets of timing information normally being displayed when said first subset is at a predetermined time setting and for providing fifth output signals which are utilized for advancing said third set of timing information signals when said first subset is set at any other time than said predetermined time setting.

* * * * *